US009401116B2

(12) United States Patent
Matsuura

(10) Patent No.: US 9,401,116 B2
(45) Date of Patent: Jul. 26, 2016

(54) IMAGE DISPLAY APPARATUS AND CONTROL METHOD FOR SAME

(71) Applicant: CANON KABUSHIKI KAISHA, Tokyo (JP)

(72) Inventor: Yasuhiro Matsuura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 344 days.

(21) Appl. No.: 14/167,374

(22) Filed: Jan. 29, 2014

(65) Prior Publication Data

US 2014/0218345 A1 Aug. 7, 2014

(30) Foreign Application Priority Data

Feb. 5, 2013 (JP) ..... 2013-020511
Dec. 19, 2013 (JP) ..... 2013-262205

(51) Int. Cl.
*G09G 5/00* (2006.01)
*G09G 3/34* (2006.01)

(52) U.S. Cl.
CPC ..... *G09G 3/3426* (2013.01); *G09G 2320/0233* (2013.01); *G09G 2320/043* (2013.01); *G09G 2320/062* (2013.01); *G09G 2320/0646* (2013.01); *G09G 2360/141* (2013.01); *G09G 2360/145* (2013.01); *G09G 2360/16* (2013.01)

(58) Field of Classification Search
None
See application file for complete search history.

(56) References Cited

U.S. PATENT DOCUMENTS

2001/0048406 A1* 12/2001 Masumoto ..... G09G 3/02 345/48
2010/0128051 A1* 5/2010 Mizuta ..... H05B 33/086 345/589
2011/0279749 A1* 11/2011 Erinjippurath ..... G09G 3/3426 349/61

FOREIGN PATENT DOCUMENTS

JP 2008-310147 A 12/2008

* cited by examiner

*Primary Examiner* — Adam R Giesy
(74) *Attorney, Agent, or Firm* — Fitzpatrick, Cella, Harper & Scinto

(57) ABSTRACT

An image display apparatus includes: an illumination unit having a light source block including a plurality of light sources; a display unit which displays an image on the basis of an image signal; a plurality of measurement units which measure the brightness of light arriving from the light source block, at a plurality of measurement positions; a storage unit which stores brightness information relating to an initial brightness of light arriving from the light source block, at at least the plurality of measurement positions; a setting unit which adjusts alight emission amount of the light source block on the basis of the brightness information, and measurement results when the light source block is lit; and a correction unit which corrects the image signal on the basis of the brightness information, the measurement results, and the adjusted light emission amount of the light source block.

20 Claims, 12 Drawing Sheets

| | INITIAL (T0) | OVER TIME (T1) | CHANGE IN BRIGHTNESS |
|---|---|---|---|
| BRIGHTNESS DETECTION VALUE OF S1 $L_{S1B1}(t)$ | 100 | 95 | 0.950 |
| BRIGHTNESS DETECTION VALUE OF S2 $L_{S2B1}(t)$ | 100 | 75 | 0.750 |
| BRIGHTNESS OF B1 $L_{B1}(t)$ | 100 | 85 | 0.850 |

*Fig.7*

IMAGE DISPLAY APPARATUS AND CONTROL METHOD FOR SAME

BACKGROUND OF THE INVENTION

1. Field of the Invention

The present invention relates to an image display apparatus and a control method for same.

2. Description of the Related Art

Broadly speaking, backlights for liquid crystal display apparatuses are referred to either as edge-lit (side-lit) or direct-lit systems. Edge-lit systems involve light sources arranged at the periphery of a light guide panel disposed at the rear of a liquid crystal panel, and direct-lit systems involve light sources arranged at the rear of a liquid crystal panel such that the liquid crystal panel is illuminated directly from the rear surface. In general, both types of backlight are composed as a single backlight unit by combining several light sources into a light source block, and then combining a plurality of these light source blocks.

Here, if the light sources in the backlight are light-emitting diodes (called, "LED" below), then a light source drive circuit is connected to each light source block, and a constant current is passed through the light source drive circuit, thereby causing the LEDs to emit light. However, since there are individual differences in the brightness and chromaticity of the LEDs, then brightness unevenness (non-uniformities) and color unevenness (non-uniformities) occur in the backlight when the same current is passed through all of the light source blocks. Therefore, in order to suppress brightness unevenness and color unevenness, it is common to adjust the LED drive conditions of the respective light source blocks before shipping the product.

Furthermore, in response to change in the brightness of a LED as a result of deterioration over time or temperature change arising after product shipment, it is common for brightness unevenness and color unevenness in the backlight to be suppressed by determining a brightness change amount by a brightness detection circuit and adjusting the LED drive conditions in accordance with the brightness change amount.

One example of a processing method for suppressing brightness unevenness caused by deterioration over time of a LED of this kind is the technology described in Japanese Patent Application Publication No. 2008-310147. In Japanese Patent Application Publication No. 2008-310147, in an edge-type backlight, the display region of the liquid crystal panel is divided into a plurality of regions, the brightnesses of the respective regions are measured, and distribution data indicating a distribution of the brightness is detected from the measured brightness information. The gradation of the image signal is then adjusted on the basis of the distribution data, and the amount of light from the backlight is controlled on the basis of this distribution data and the image signal.

According to Japanese Patent Application Publication No. 2008-310147, if the brightness distribution when the LEDs are lit can be approximated to a Gaussian distribution, then brightness unevenness caused by deterioration over time of the backlight can be eliminated by controlling the amount of light of the backlight on the basis of the brightness distribution and the image signal.

SUMMARY OF THE INVENTION

If there are individual differences in the extent of the deterioration over time of a plurality of LEDs which constitute one light source block, then the brightness distribution when the plurality of LEDs is lit is not that expected at the design stage. Because of this, it is not possible to suppress brightness unevenness with the image processing described Japanese Patent Application Publication No. 2008-310147. Furthermore, if there are individual differences in the extent of the deterioration over time of the plurality of LEDs which constitute the same light source block, then brightness unevenness will occur in the backlight even if the drive conditions of the LEDs are adjusted.

Therefore, the present invention provides technology for suppressing brightness unevenness and color unevenness due to the occurrence of individual differences in the extent of deterioration over time of a plurality of light sources which constitute one light source block.

A first aspect of the invention is an image display apparatus, including: an illumination unit having a light source block including a plurality of light sources; a display unit which displays an image on the basis of an image signal; a plurality of measurement units which measure the brightness of light arriving from the light source block, at a plurality of measurement positions; a storage unit which stores brightness information relating to an initial brightness of light arriving from the light source block, at at least the plurality of measurement positions; a setting unit which adjusts a light emission amount of the light source block on the basis of the brightness information stored in the storage unit, and measurement results from the plurality of measurement units when the light source block is lit; and a correction unit which corrects the image signal on the basis of the brightness information stored in the storage unit, the measurement results from the plurality of measurement units, and the adjusted light emission amount of the light source block.

A second aspect of the invention is a method for controlling an image display apparatus that includes: an illumination unit having a light source block including a plurality of light sources; a display unit which displays an image on the basis of an image signal; and a plurality of measurement units which measure the brightness of light arriving from the light source block, at a plurality of measurement positions, the method including: reading, from a storage unit, brightness information relating to an initial brightness of light arriving from the light source block, at at least the plurality of measurement positions; adjusting a light emission amount of the light source block on the basis of the brightness information stored in the storage unit, and measurement results from the plurality of measurement units when the light source block is lit; and correcting the image signal on the basis of the brightness information stored in the storage unit, the measurement results from the plurality of measurement units, and the adjusted light emission amount of the light source block.

According to the present invention, it is possible to suppress brightness unevenness and color unevenness due to the occurrence of individual differences in the extent of deterioration over time of a plurality of light sources which constitute the same light source block.

Further features of the present invention will become apparent from the following description of exemplary embodiments with reference to the attached drawings.

BRIEF DESCRIPTION OF THE DRAWINGS

FIG. 7 is a table showing change in the brightness detection value at an initial timing and after deterioration over time;

DESCRIPTION OF THE EMBODIMENTS

First Example

Figure 1:
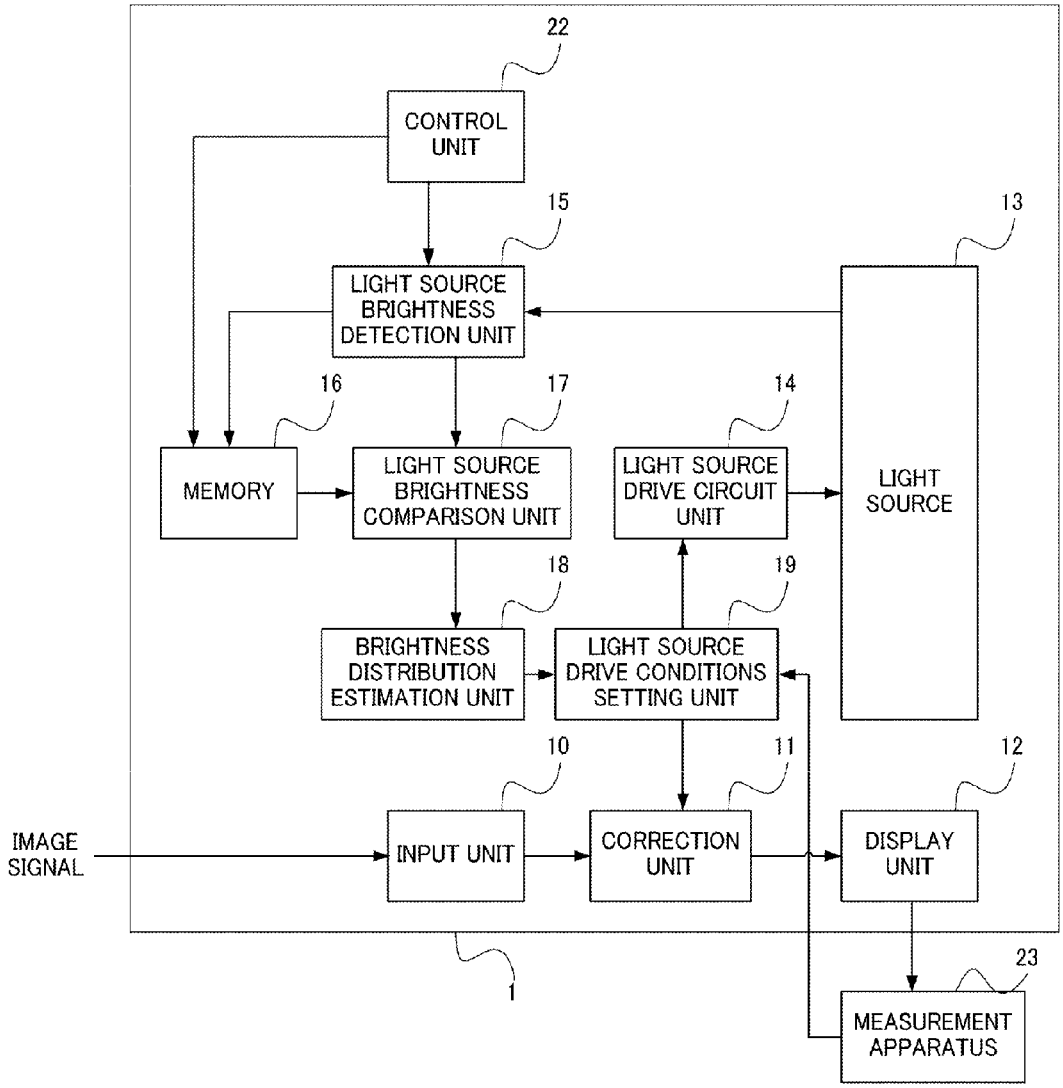
FIG. 1 is a block diagram showing the schematic composition of the liquid display apparatus and backlight relating to an embodiment of the invention.

FIG. 1 is a block diagram showing a general composition of an image display apparatus relating to an embodiment of the present invention. Below, the composition of a liquid crystal display apparatus according to a first example of the present invention will be described with reference to FIG. 1.

The liquid crystal display apparatus 1 shown in FIG. 1 is constituted by an input unit 10, a correction unit 11, a display unit 12, a light source 13, a light source drive circuit unit 14, a light source brightness detection unit 15, a memory 16, a light source brightness comparison unit 17, a brightness distribution estimation unit 18, a light source drive conditions setting unit 19 and a control unit 22.

The input unit 10 is an interface which receives an image signal output from an external image signal output apparatus (not illustrated).

The correction unit 11 applies a correction designated by the user to the image signal received by the input unit 10 and outputs the corrected signal. Furthermore, if there is a brightness unevenness or color unevenness in the light emission state of the light source 13, which is described below, then a correction for suppressing the unevenness is applied to the image signal.

The display unit 12 receives the image signal to which a correction has been applied under the conditions designated by the user in the correction unit 11, and displays an image based on the image signal. In the present invention, the display unit 12 is a liquid crystal panel, but the embodiments of the present invention are not limited to a liquid crystal panel.

The light source 13 is a light source which illuminates the display unit 12 from the rear side, and is provided with a plurality of light-emitting elements, such as light-emitting diodes (LEDs), or individual light sources, such as fluorescent lamps. Furthermore, in the present invention, a group of light sources which combines a plurality of individual light sources is defined as a light source block, and the light source 13 has one or more light source blocks. In the light source 13 which is composed to include a plurality of light source blocks, it is possible to control light emission independently in each light source block. More specifically, the light source 13 is divided (split) into one or a plurality of light source blocks in which light emission can be controlled independently, and the respective light source blocks are each constituted by a plurality of individual light sources (light-emitting elements).

The light source drive circuit unit 14 is constituted by a plurality of light source drive circuits which individually drive the respective light source blocks. The light source drive circuit unit 14 is constituted by a constant-current circuit and a PWM drive circuit, and adjusts the lighting brightness (light emission amount) of each light source block, by adjusting the pulse width modulation amount for PWM drive (duty ratio) and the amount of current for each light source block. The light source drive circuit unit 14 can adjust the light emission amount in individual light source blocks, but it is not possible to adjust the light emission amount in each of the individual light sources which constitute the light source blocks. This is because the individual light sources which constitute the light source block are connected to the same light source drive circuit.

The light source brightness detection unit 15 measures the brightness of the light source 13 when the light source block is lit up. The light source brightness detection unit 15 is constituted by a brightness sensor IC capable of determining the brightness of monochromatic light or light of a plurality of colors. The light source brightness detection unit 15 has a plurality of brightness sensors which measure the brightness of light arriving from the light source block, at a plurality of measurement positions.

The memory 16 is a storage apparatus which stores an initial brightness value when the light source blocks are lit under the prescribed conditions.

The light source brightness comparison unit 17 compares the initial brightness value stored in the memory 16 and a brightness value detected by the light source brightness detection unit 15 after deterioration over time, and detects the extent of deterioration over time of the individual light sources which constitute a light source block.

The brightness distribution estimation unit 18 estimates a brightness distribution (brightness profile) of the light source block from the extent of deterioration over time of the individual light sources calculated by the light source brightness comparison unit 17.

The light source drive conditions setting unit 19 sets a light emission amount for each light source block whereby brightness unevenness and color unevenness can be suppressed when all of the light source blocks constituting the light source 13 are lit, on the basis of the shape of the brightness distribution of the light source block estimated by the brightness distribution estimation unit 18. The light emission amounts thus set are sent to the light source drive circuit unit 14 as drive conditions for the light source 13.

The control unit 22 controls the operation of the respective functional blocks described above, such as the light source brightness detection unit 15, in order to carry out brightness distribution measurement processing, brightness correction processing and brightness distribution estimation processing, and the like, as described below.

The foregoing is a composition of a backlight for a liquid crystal display apparatus according to a first example of the present invention. The present invention is not limited to a backlight for a liquid crystal display apparatus, and can also be applied to general illumination apparatuses which are constituted by a plurality of light source blocks, in which each light source block is constituted by a plurality of individual light sources.

Figure 2:
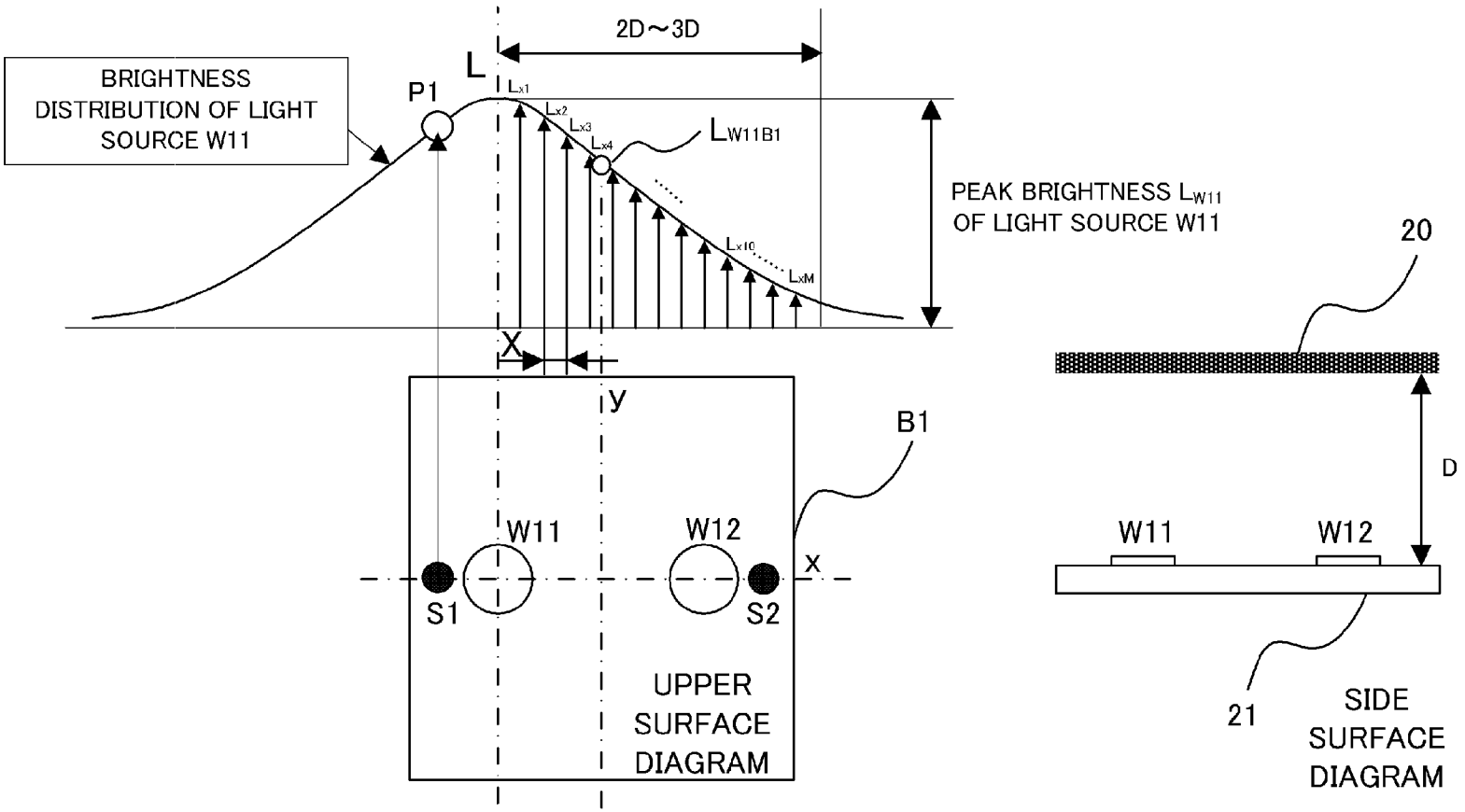
FIG. 2 is a diagram showing a relationship between the brightness distribution of the individual light source W11 and the brightness detection value.
Figure 3:
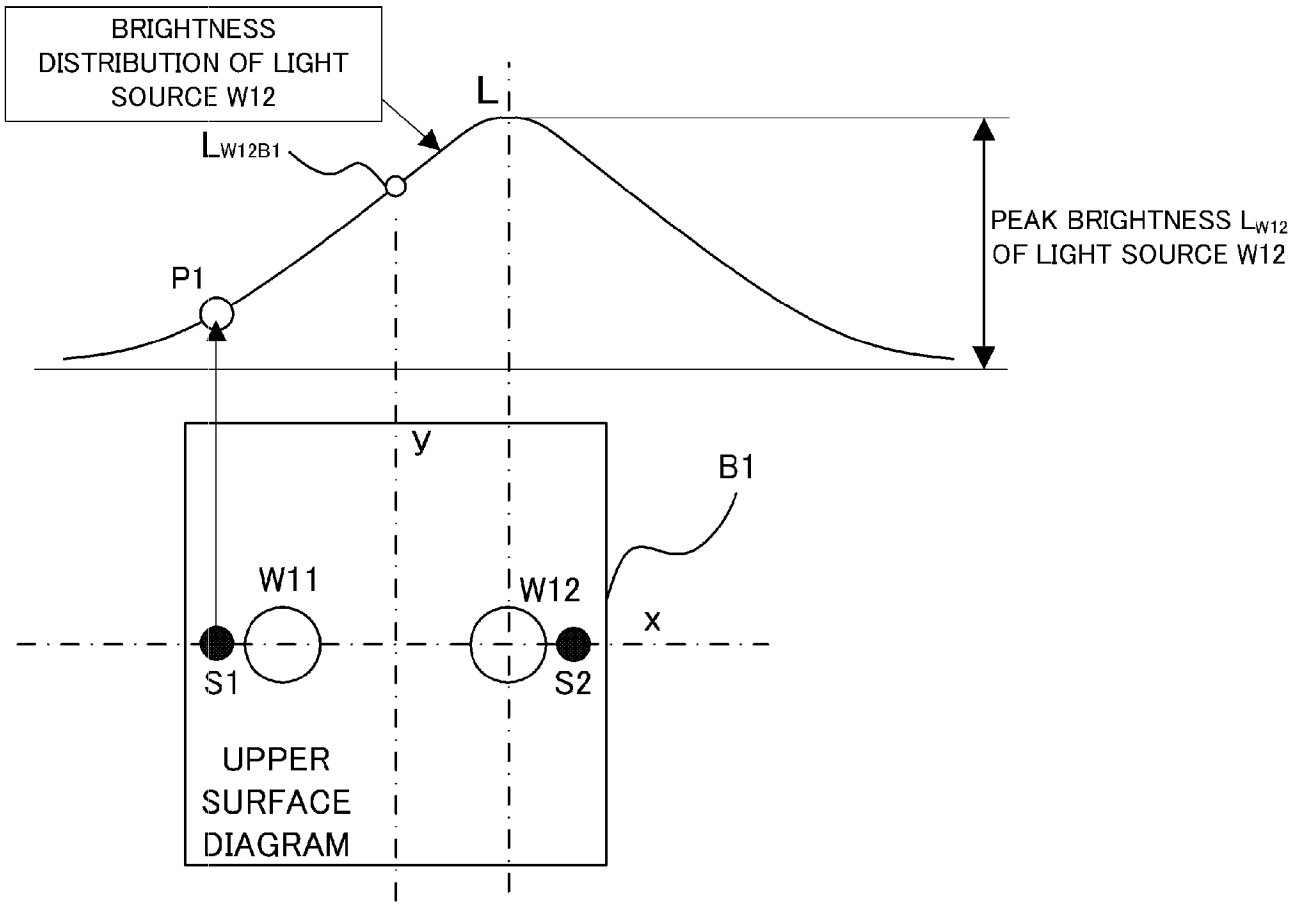
FIG. 3 is a diagram showing a relationship between the brightness distribution of the individual light source W12 and the brightness detection value.
Figure 4:
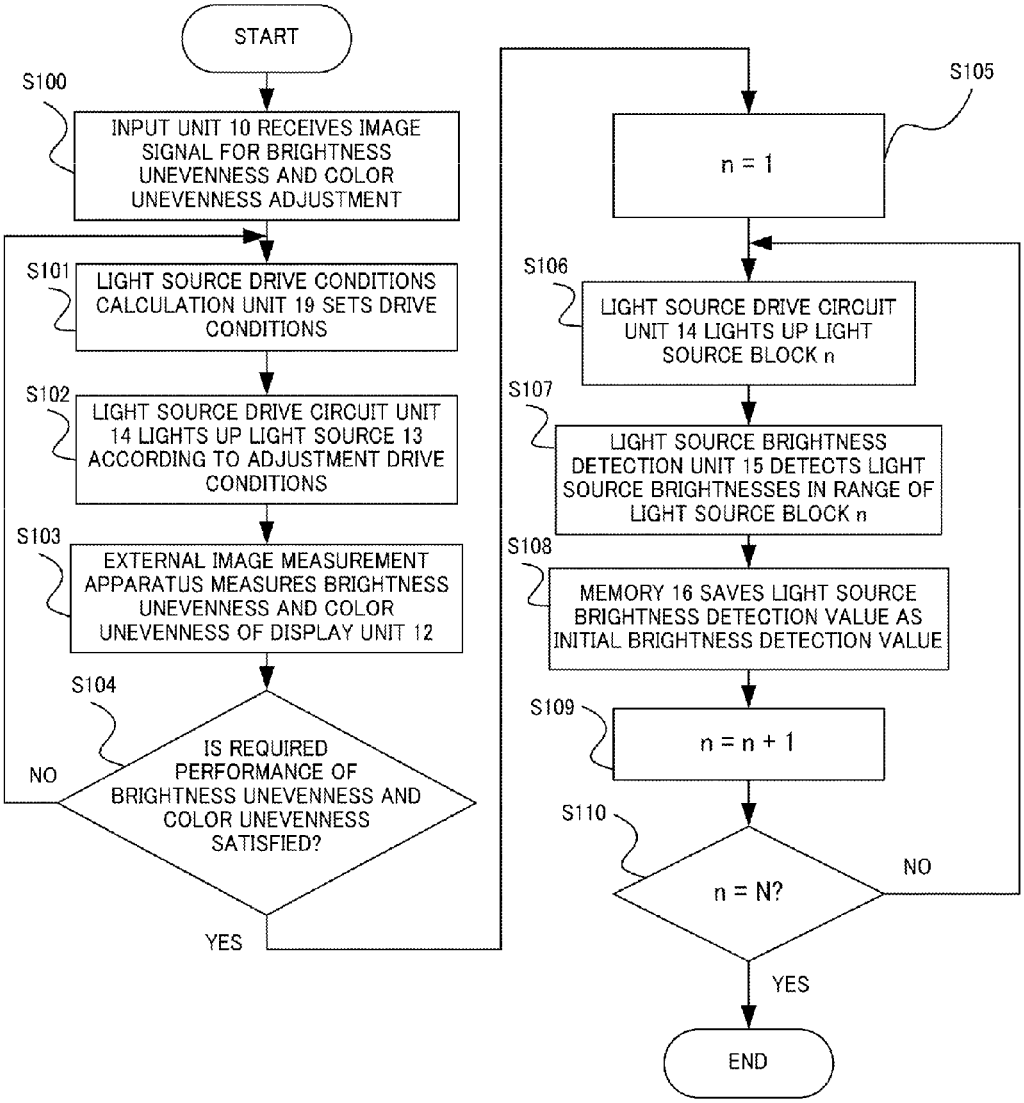
FIG. 4 is a flowchart for describing an initial brightness measurement process.
Figure 5:
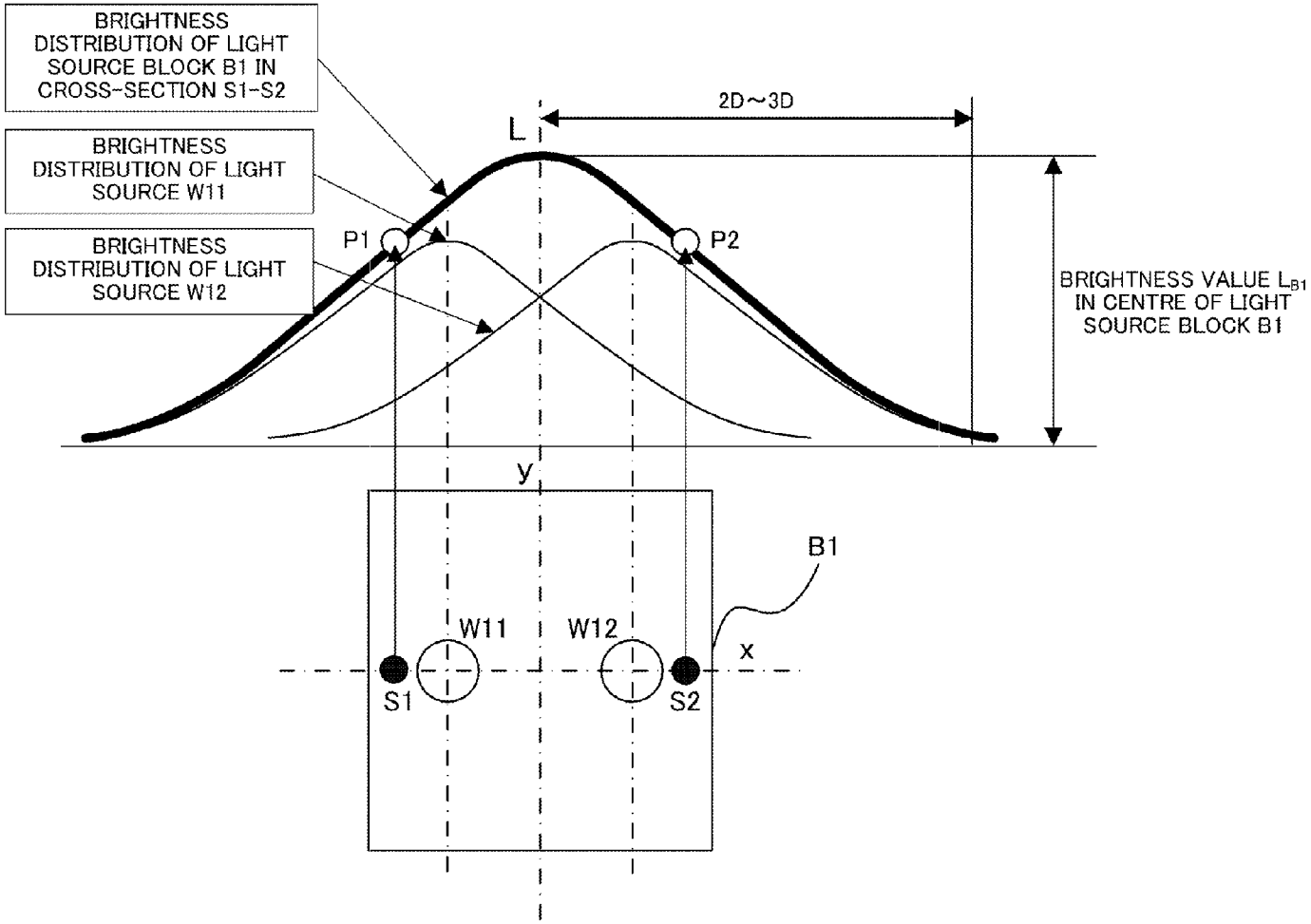
FIG. 5 shows a relationship between the brightness distribution and the brightness detection value when the light source block is lit.

Next, an initial brightness measurement process for a backlight of a liquid crystal display apparatus according to the first example of the present invention will be described with reference to FIG. 2, FIG. 3, FIG. 4 and FIG. 5. FIG. 2 and FIG. 3 are diagrams showing a relationship between the brightness distribution of the individual light source according to the present invention, and the brightness detected by the light source brightness detection unit 15. FIG. 4 is a flowchart for describing the initial brightness measurement process according to the present invention. Moreover, FIG. 5 is a diagram showing a relationship between the brightness distribution when the light source blocks constituting the light source 13 is lit, and the brightness detected by the light source brightness detection unit 15.

Firstly, as a preliminary preparation, a relationship between the basic brightness distribution of the individual light sources and the brightness (brightness detection value) detected by the light source brightness detection unit 15 when the individual light sources are lit is measured, and the brightness distribution information relating to the performance of the diffusion structure is stored in the memory 16. It is assumed that the brightness distribution of the individual light sources is measured by separately providing a structure for causing only the individual light sources to light up. FIG. 2 shows the brightness detection values obtained by the brightness detection sensor S1 of the light source brightness detection unit 15 when the individual light source W11 is lit.

As shown in FIG. 2, in the present example, the light source 13 is taken to be a direct light source. The brightness distribution when the individual light source W11 in FIG. 2 is lit has a peak brightness $L_{W11}$ directly above the individual light source W11, and the brightness declines as the distance from the individual light source W11 increases. The brightness distribution of the individual light source W11 can be detected by measuring the brightness at each one of predetermined distances X from the individual light source W11. In FIG. 2, the brightness at a distance of $X_1$ from the individual light source W11 is defined as $L_{X1}$, the brightness at a distance of $X_2$ is defined as $L_{X2}$, and measurement is made up to a distance of 2D to 3D from the light source. Here, D is the spatial distance from the substrate 21 on which the LED is provided to a diffusion plate 20.

The information (brightness distribution information) relating to the initial (T0) brightness distribution of the individual light source is stored previously in the memory 16, on the basis of these measurement results. The brightness values $L_{X1}(T0), L_{X2}(T0), L_{X3}(T0), \ldots, L_{XM}(T0)$ measured at each of the predetermined distances Xm (m=1, 2, 3, . . . M) from the individual light source W11 are previously stored in the memory 16 as information relating to the initial brightness distribution of the individual light source W11. Similarly, information relating to the initial brightness distribution for the individual light source W12 and other individual light sources is stored previously in the memory 16. The initial (T0) brightness distribution information of the individual light source stored in this way is used for the calculation in Formula (9) which is described hereinafter. It is also possible to calculate which kind of coefficient, when multiplied by the measurement brightness value from the brightness detection sensor S1, yields the brightness values measured at each of the predetermined distances Xm from the individual light source W11, and to store the determined coefficient previously in the memory 16.

Furthermore, the brightness at the central position of the light source block B1 in the brightness distribution of the individual light source W11, is defined as $L_{W11B1}$. Similarly, the brightness at the central position of the light source block B1 in the brightness distribution of the individual light source W12, is defined as $L_{W12B1}$. In the present example, the shape of the initial brightness distribution when using the image display apparatus having the individual light source W11 and the individual light source W12 is taken to be the same, in order to simplify the description. However, the change with use in the brightness distribution of the individual light sources is not limited to being the same.

Furthermore, the brightness detection value obtained by the light source brightness detection unit 15 when the individual light source is lit is described here. If the brightness detection value obtained by the brightness detection sensor S1 of the light source brightness detection unit 15 when the individual light source W11 in FIG. 2 is lit is taken to be $L_{S1W11}$, then the brightness detection sensor S1 detects the position P1 in the brightness distribution of the individual light source W11. In this case, $L_{S1W11}$ is expressed by Expression 1 below.

[Expression 1]

$$L_{S1W11}=C_{W11S1}\times L_{W11} \tag{1}$$

Here, the coefficient $C_{W11S1}$ is a coefficient which depends on the diffusion structure of the diffusion plate or diffusion sheet, and the reflection plate, and the like, which is disposed on the light source 13, and is determined from the measurement values.

Furthermore, FIG. 3 is a diagram showing the brightness detection values acquired by the brightness detection sensor S1 of the light source brightness detection unit 15 when the individual light source W12 is lit. If the brightness detection value acquired by the brightness detection sensor S1 when the individual light source W12 is lit is taken to be $L_{S1W12}$, the brightness detection sensor S1 detects the brightness at the position P1 in the brightness distribution of the individual light source W12, in which case, $L_{S1W12}$ is represented by Expression 2 below.

[Expression 2]

$$L_{S1W12}=C_{W12S1}\times L_{W12} \tag{2}$$

The coefficient $C_{W12S1}$ is determined from the measurement values.

Below, the brightness detection value $L_{S2W11}$ obtained by the brightness detection sensor S2 when the individual light source W11 is lit is similarly represented by Expression 3 below.

[Expression 3]

$$L_{S2W11}=C_{W11S2}\times L_{W11} \tag{3}$$

The brightness detection value $L_{S2W12}$ obtained by the brightness detection sensor S2 when the individual light source W12 is lit can similarly be represented by Expression 4 below.

[Expression 4]

$$L_{S2W12}=C_{W12S2}\times L_{W12} \tag{4}$$

In the present example, the extent of deterioration over time of the respective LEDs is estimated using the relationships in Expression (1) to Expression (4).

Next, the initial brightness measurement process of the present invention will be described with reference to FIG. 4 and FIG. 5.

Firstly, in step S100 in FIG. 4, the input unit 10 receives an image signal for brightness unevenness and color unevenness adjustment, and sends same to the correction unit 11. The correction unit 11 sends the adjustment image signal to the display unit 12, and the display unit 12 displays an image on the basis of the image signal.

Next, in step S101, the light source drive conditions setting unit 19 sets drive conditions for initial adjustment of brightness unevenness and color unevenness, and sends same to the light source drive circuit unit 14.

Next, in step S102, the light source drive circuit unit 14 causes the light source 13 to light up according to the drive conditions for initial adjustment of brightness unevenness and color unevenness. In unevenness adjustment, all of the light source blocks constituting the light source 13 are caused to light up simultaneously. Here, the light source 13 according to the present example is constituted by the light source block B1 only, as shown in FIG. 5, in order to simplify the description, and the light source block B1 has a total of two individual light sources, the individual light source W11 and the individual light source W12, each of these individual light sources being a white LED. Furthermore, the individual light source W11 and the individual light source W12 are electrically connected in series in the light source block B1, and are connected to one light source drive circuit. It is supposed that two brightness detection sensors S1 and S2 are disposed.

Next, at step S103, the light source drive conditions setting unit 19 acquires the measurement results for brightness unevenness and color unevenness of the display unit 12 by the external measurement apparatus 23 of the liquid crystal display apparatus 1. The measurement apparatus 23 and the liquid crystal display apparatus 1 are connected by a wired or wireless communications device, and information is transmitted and received therebetween.

Next, at step S104, the light source drive conditions setting unit 19 detects whether or not the brightness unevenness and color unevenness measured at step S103 satisfy the required performance (specifications). Here, if the brightness unevenness or the color unevenness do not satisfy the required performance, then the light source drive conditions setting unit 19 returns to step S101 and finely adjusts the light source drive conditions of each light source block on the basis of the measurement values for the brightness unevenness and color unevenness.

The processing from step S101 to step S104 above is carried out repeatedly until the brightness unevenness and the color unevenness satisfy the required performance.

In step S104, if it is determined that the brightness unevenness and the color unevenness have satisfied the specifications, the control unit 22 carries out respective initial brightness distribution measurements for all of the light source blocks constituting the light source 13.

Firstly, in step S105, the control unit 22 sets an initial value of 1 for the counter n of the light source block number. Numbers of 1 to N are assigned to the N light source blocks which constitute the light source 13.

Next, in step S106, the light source drive circuit unit 14 lights up only the nth light source block. In FIG. 5, the light source drive circuit unit 14 lights up only the light source block B1.

Next, in step S107, the light source brightness detection unit 15 acquires the brightness detection value from a brightness detection sensor situated around the nth light source block. The number and positions of the brightness sensors which acquire the brightness detection values are determined by estimating the diffusion range of the light source from the arrangement interval of the light source blocks and the diffusion structure thereof. For example, if the spatial distance from the light source to the diffusion plate is D, then the brightness detection value should be obtained from a brightness detection sensor located within a circle of radius 2D to 3D from the central point of the light source block. According to FIG. 5, the brightness detection sensors situated in a range of radius 2D to 3D from the central point of the light source block B1 are S1 and S2. Consequently, the light source brightness detection unit 15 acquires brightness detection values from the brightness detection sensors S1 and S2 when the light source block B1 is lit, and sets these as an initial brightness value for the light source block B1.

The relationship between the brightness distribution when the light source block shown in FIG. 5 is lit, and the brightness detection value acquired by the light source brightness detection unit 15, will now be described in detail.

As shown in FIG. 5, the brightness distribution of the light source block B1 is obtained by summing the brightness distribution of the individual light source W11 and the brightness distribution of the individual light source W12. In this case, the brightness detected by the brightness detection sensor S1 is the brightness at the position P1 in the brightness distribution of the light source block B1. Furthermore, the brightness detected by the brightness detection sensor S2 is the brightness at P2 in the brightness distribution of the light source block B1.

Here, the brightness detection value acquired by the brightness detection sensor S1 during initial brightness detection will be described. The brightness directly above the individual light source W11 when only the individual light source W11 is lit, is $L_{W11}$, and the brightness directly above the individual light source W12 when only the individual light source W12 is lit, is $L_{W12}$. In this case, the brightness detection value $L_{S1B1}$ acquired by the brightness detection sensor S1 when the light source block B1 is lit, is represented by Expression (5) below.

[Expression 5]

$$L_{S1B1}=C_{W11S1}\times L_{W11}+C_{W12S1}\times L_{W12} \tag{5}$$

Similarly, the brightness detection value $L_{S2B1}$ acquired by the brightness detection sensor S2 when the light source block B1 is lit, is represented by Expression (6) below.

[Expression 6]

$$L_{S2B1}=C_{W11S2}\times L_{W11}+C_{W12S2}\times L_{W12} \tag{6}$$

By solving the simultaneous equations in Expression (5) and Expression (6) above, in respect of $L_{W11}$, the brightness $L_{W11}$ of the individual light source W11 constituting the light source block B1 is represented by Expression (7) below.

[Expression 7]

$$L_{W11}=\frac{C_{W12S2}L_{S1B1}-C_{W12S1}L_{S2B1}}{C_{W12S2}C_{W11S1}-C_{W12S1}C_{W11S2}} \tag{7}$$

Similarly, the brightness $L_{W12}$ of the individual light source W12 which constitutes the light source block B1 is represented by Expression (8) below.

[Expression 8]

$$L_{W12} = \frac{C_{W11S2}L_{S1B1} - C_{W11S1}L_{S2B1}}{C_{W11S2}C_{W12S1} - C_{W11S1}C_{W12S2}} \quad (8)$$

The brightnesses $L_{W11}$ and $L_{W12}$ of the individual light source W11 and the individual light source W12 are derived from the brightness detection value $L_{S1B1}$ detected by the brightness detection sensor S1 and the brightness detection value $L_{S2B1}$ detected by the brightness detection sensor S2, on the basis of Expression (7) and Expression (8) described above.

The foregoing describes the brightness detection process carried out in step S107 on the basis of the determination results from the light source brightness detection unit 15.

After carrying out the processing in step S107, at step S108, the control unit 22 saves the brightness detection value acquired by the light source brightness detection unit 15 in the memory 16 as the brightness detection value of the nth light source block.

Next, at step S109, the control unit 22 increments the light source block number counter by 1.

Thereupon, in step S110, the control unit 22 determines whether or not the light source block number counter matches the number of light source blocks (N). If the counter does not match the number of light source blocks, then the control unit 22 returns to step S106 and repeats the processing from S106 to S109.

The control unit 22 carries out the series of processing described above until measurement has been completed for all of the light source blocks.

Figure 6:
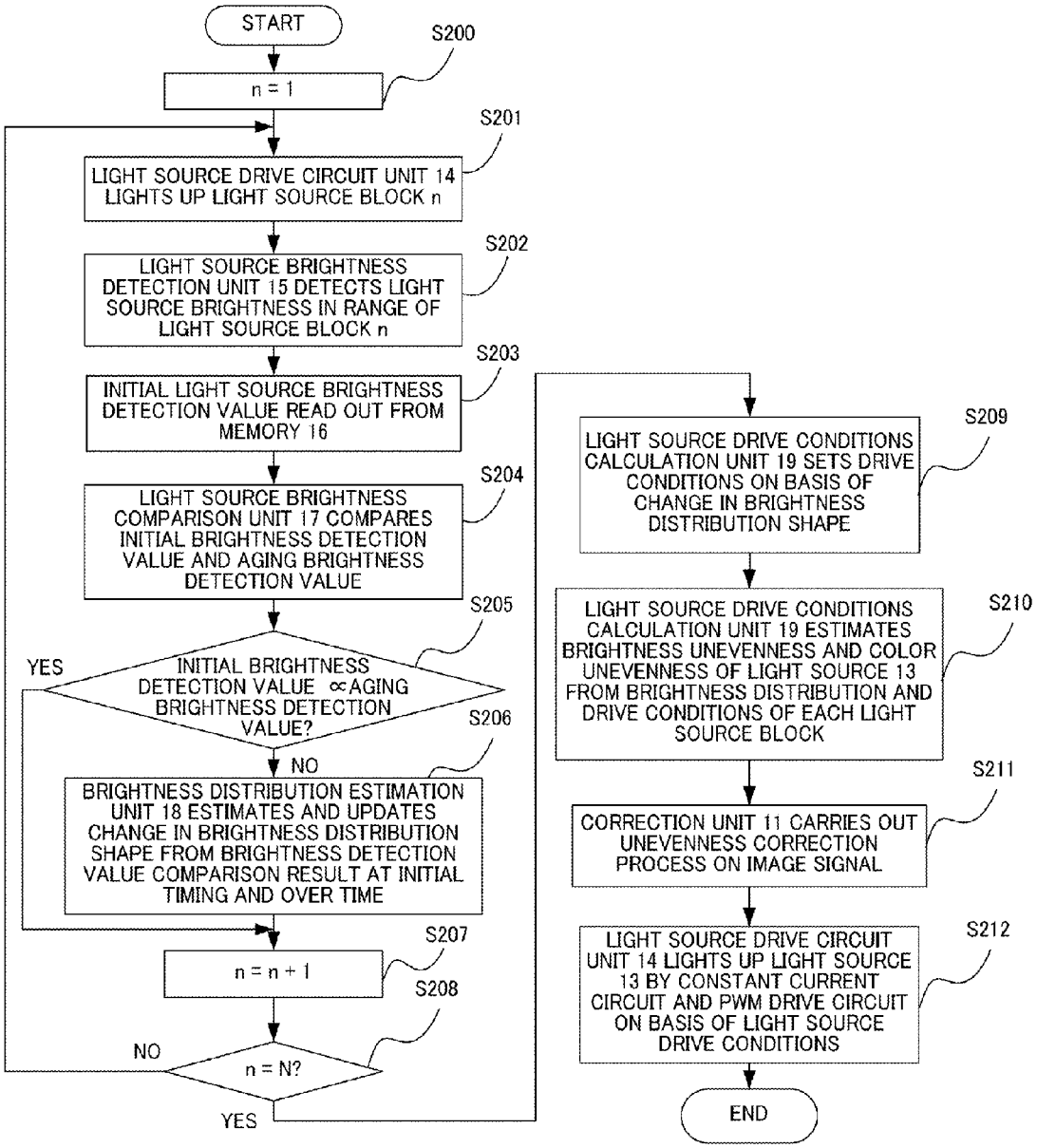
FIG. 6 is a flow of brightness correction processing based on the brightness distribution shape estimated after deterioration over time.
Figure 8:
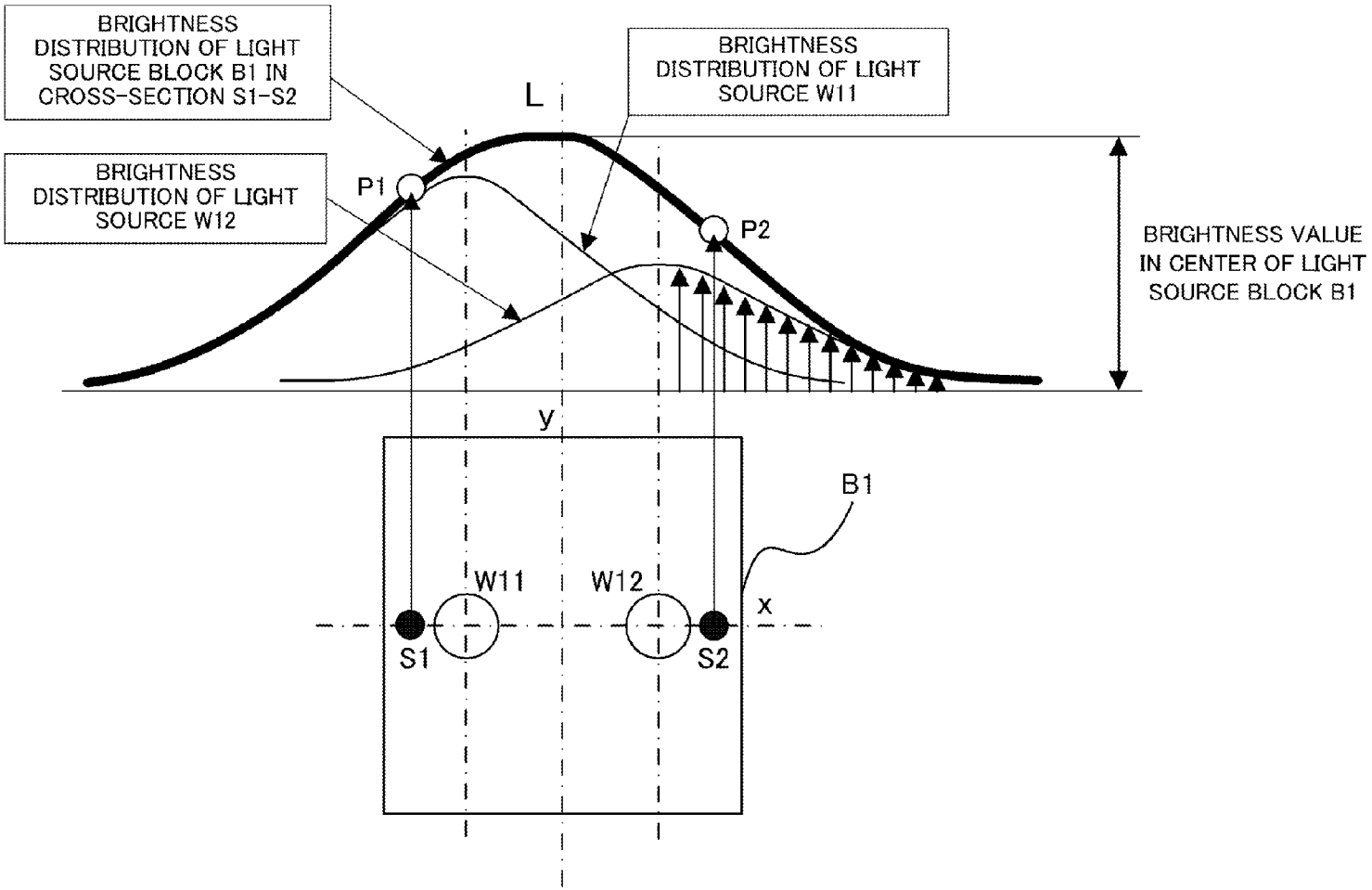
FIG. 8 is a diagram showing the brightness distribution after deterioration over time.

Next, the brightness distribution estimation process and the brightness correction process of the present invention will be described with reference to FIG. 6, FIG. 7 and FIG. 8. FIG. 6 is a flowchart of a case where a brightness correction process is carried out on the basis of an estimated brightness distribution shape after deterioration over time. FIG. 7 is a table showing change in the brightness detection value and the brightness of the light source block B1 acquired from the brightness detection sensor initially and after deterioration over time. Furthermore, FIG. 8 is a diagram showing the brightness distribution after deterioration over time.

Firstly, a flowchart of a case where a brightness distribution estimation process and a brightness correction process are carried out is described here with reference to FIG. 6.

Initially, in step S200 in FIG. 6, the control unit 22 sets a value of 1 for the counter n of the light source block number.

Next, in step S201, the light source drive circuit unit 14 lights up only the nth light source block.

Next, in step S202, the light source brightness detection unit 15 acquires the brightness detection values from brightness detection sensors situated around the nth light source block. Here, the number and positions of the brightness detection sensors which acquire the brightness detection value are taken to be the same as in the measurement performed in step S107 shown in FIG. 4. The light source brightness detection unit 15 sends the measured brightness detection values to the light source brightness comparison unit 17.

Next, in step S203, the light source brightness comparison unit 17 reads out the initial brightness detection values stored in the memory 16, at step S108 in FIG. 4, from the memory 16.

Thereupon, in step S204, the light source brightness comparison unit 17 compares the initial brightness detection values read out at step S203 and the aging brightness detection values measured at step S202.

Next, in step S205, the light source brightness comparison unit 17 determines whether or not the proportional relationship between the initial brightness detection value and the aging brightness detection value is the same in each of the plurality of brightness detection sensors, on the basis of the comparison results of the brightness detection values carried out in step S204. In other words, the light source brightness comparison unit 17 determines whether or not the rate of change of the aging brightness detection value with respect to the initial brightness detection value produced by the brightness detection sensor S1, and the rate of change of the aging brightness detection value with respect to the initial brightness detection value produced by the brightness detection sensor S2, are the same. Here, if the difference between the brightness detection sensors in terms of the rate of change in the aging brightness detection value with respect to the initial brightness detection value is no greater than a threshold value, then it is determined that the proportional relationship between the initial brightness detection value and the aging brightness detection value is the same in both of the plurality of brightness detection sensors. If it is determined in step S205 that the proportional relationship is the same, then the light source brightness comparison unit 17 determines that the deterioration over time of the brightness of the individual light sources which constitute the light source block is uniform, and then advances to step S207.

In step S205, if the proportional relationship is determined not to be the same, then the light source brightness comparison unit 17 determines that unevenness has occurred in the extent of deterioration in the brightness of the individual light sources in the same light source block, and advances to step S206.

In step S206, the brightness distribution estimation unit estimates the change in the shape of the brightness distribution.

Here, the brightness distribution estimation process carried out by the brightness distribution estimation unit 18 in step S206 will be described with reference to FIG. 7 and FIG. 8.

Firstly, the brightness distribution estimation unit 18 reads out the brightness detection values $L_{S1B1}(T0)$ and $L_{S2B1}(T0)$ detected by the brightness detection sensors S1 and S2 at the initial timing (time T0) in the light source block B1 from the memory 16. Next, the brightness distribution estimation unit compares the brightness detection values $L_{S2B2}(T1)$ and $L_{S2B1}(T1)$ detected by the brightness detection sensors S1 and S2 over time (at time T1) with the initial brightness detection value.

An example of the comparison results is shown in FIG. 7. According to FIG. 7, the brightness detection value from the brightness detection sensor S1 declines by 5%, the brightness detection value from the brightness detection sensor S2 declines by 25%, and therefore the extent of change in the brightness detection value from the brightness detection sensor S2 is greater than the extent of change in the brightness detection value from the brightness detection sensor S1. In other words, the proportional relationship between the initial brightness detection value and the aging brightness detection value is different between the brightness detection sensors S1 and S2.

In this case, since the brightness detection sensor S2 is disposed in the vicinity of the individual light source W12, then it is predicted that deterioration of the individual light source W12 has progressed more quickly than the individual light source W11. In this case, it is predicted that, in the vicinity of the individual light source W12, the shape of the brightness distribution after the passage of time in the light source block B1 will change by the brightness change amount between the initial value and the aging value of the individual light source W12.

The aging brightness distribution of the individual light source W12 can be expressed by the following Expression 9 in which the initial brightness distribution of the individual light source W12 is multiplied by the ratio between the brightness detection value at the initial timing (T0) and the aging brightness detection value (T1).

[Expression 9]

$$L_{xm}(T1) = L_{xm}(T0) \times \left( C_{W12S1} \frac{L_{S1B1}(T1)}{L_{S1B1}(T0)} + C_{W12S2} \frac{L_{S2B1}(T1)}{L_{S2B1}(T0)} \right) \quad (9)$$

$$(m = 0, 1, 2, \ldots M)$$

Here, M is the number of divisions of the brightness distribution measurement. The brightness distribution of the individual light source W11 is calculated in a similar fashion, and the sum of the brightness distributions over time of the individual light source W11 and the individual light source W12 gives the brightness distribution of the light source block B1 over time (T1).

Furthermore, the brightness $L_{B1}(T1)$ at the central point of the light source block B1 is expressed by Expression 10 below.

[Expression 10]

$$L_{B1}(T1) = \left( C_{W11S1} \frac{L_{S1B1}(T1)}{L_{S1B1}(T0)} + C_{W11S2} \frac{L_{S2B1}(T1)}{L_{S2B1}(T0)} \right) L_{W11B1}(T0) + \left( C_{W12S1} \frac{L_{S1B1}(T1)}{L_{S1B1}(T0)} + C_{W12S2} \frac{L_{S2B1}(T1)}{L_{S2B1}(T0)} \right) L_{W12B1}(T0) \quad (10)$$

Next, at step S207, the control unit 22 increments the light source block number counter by 1.

Thereupon, in step S208, the control unit 22 determines whether or not the light source block number counter matches the number of light source blocks (N). If the counter does not match the number of light source blocks, then the control unit 22 returns to step S201 and repeats the processing from S201 to S207.

Figure 9:
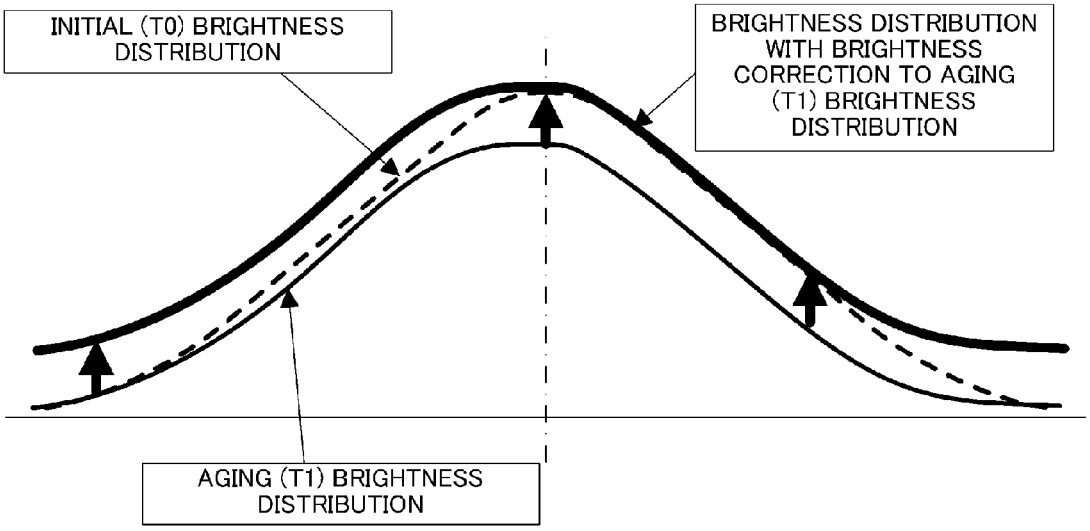
FIG. 9 shows the brightness distribution of a light source block based on brightness distribution shape measurement results.

When the brightness distribution estimation processing has been completed for all of the light source blocks, at step S209, the light source drive conditions setting unit 19 sets the new drive conditions on the basis of the change in the shape of the brightness distribution, and adjusts the light emission amount of each light source block. In the first example, the light source drive conditions setting unit 19 sets drive conditions for increasing the brightness of the light source block B1 by 33%, in accordance with the extent of change in the brightness of the light source W12, in which the decline in brightness has progressed the most. FIG. 9 shows the brightness distribution of the light source block B1 when lit according to the set drive conditions. In FIG. 9, the overall brightness increases by 33% in line with the shape of the aging brightness distribution, and it can be seen that the shape of the brightness distribution under the new drive conditions is a shape which encompasses the shape of the initial brightness distribution. The adjustment value of the light generation amount of the light source block B1 by the light source drive conditions setting unit 19 is 1.33.

Figure 10:
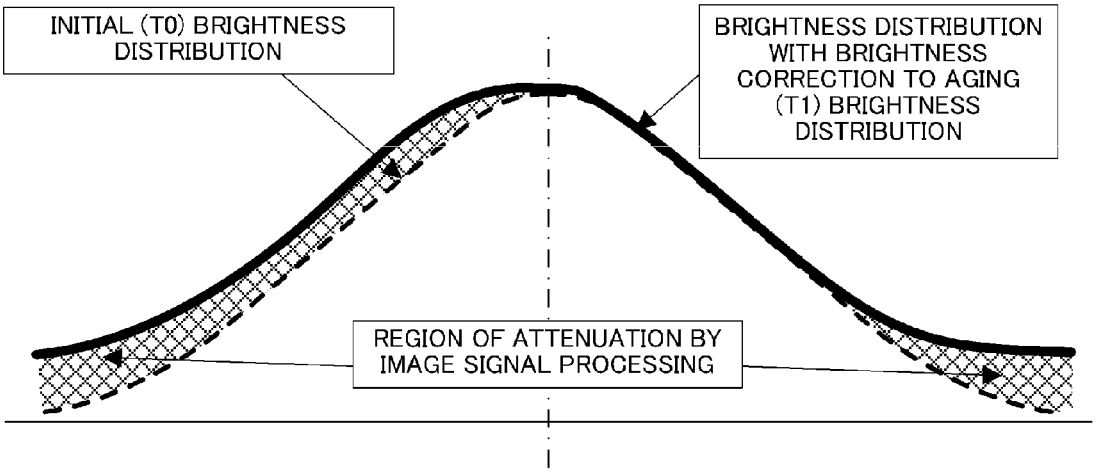
FIG. 10 is a diagram showing brightness unevenness based on brightness distribution shape measurement results.

Thereupon, in step S210, the correction unit 11 estimates the region in which the brightness is increased with respect to the initial brightness distribution, as a result of the brightness correction in step S209. The estimation results are shown in FIG. 10. In the next step, S211, in order that the region of increase in brightness does not appear to be a brightness unevenness, the correction unit 11 performs unevenness correction processing in respect of the image signal input to the display unit 12. In the example in FIG. 10, in the region where the brightness increases, correction is carried out to reduce the pixel values in accordance with the extent of increase in the brightness.

More specifically, the correction unit 11 calculates the brightness distribution when the light source block B1 is lit under the drive condition after changing settings (after adjustment), in respect of the brightness values $L_{X1}(T1)$, $L_{X2}(T1)$ $L_{X3}(T1), \ldots L_{XM}(T1)$ over time (T1) which are represented by Expression (9). More specifically, when the brightness of the light source block B1 is raised by 33%, brightness values which are 1.33 times greater than the brightness values $L_{X1}(T1)$, $L_{X2}(T1)$, $L_{X3}(T1)$, . . . $L_{XM}(T1)$ over time (T1) represented by Expression (9) are calculated. In this way, brightness distribution information over time (T1), which incorporates brightness correction according to the drive conditions after changing the settings, is calculated. The correction unit 11 calculates the difference between the brightness differential information over time (T1) according to the drive conditions after changing settings, and the initial brightness distribution information at (T0), and carries out unevenness correction processing in respect of the image signal input to the display unit 12 so as to approximate the initial brightness distribution at (T0). If the light source 13 is constituted by a plurality of light source blocks, the correction unit 11 applies correction to the image signals of the image regions corresponding to the light source blocks, on the basis of the light emission amount of each of the light source blocks.

In the present example, the brightness distribution estimation unit 18 is provided in order to achieve highly accurate correction by the correction unit 11. More specifically, a brightness distribution for each predetermined distance Xm from the individual light source at the initial timing (T0) is stored in advance, and a brightness distribution for each predetermined distance Xm from the individual light source after the passage of time (T1) is estimated. However, the present invention is not limited to this. For example, the brightness distribution estimation unit 18 may be omitted. In this case, only the initial brightness information at (T0) at the determination positions P1, P2, . . . corresponding to the brightness detection sensors S1, S2, . . . is stored previously in the memory 16. The light emission amount is adjusted for each light source block by the light source drive conditions setting unit 19, on the basis of the initial brightness information at (T0) and the brightness information over time (T1) detected by the brightness detection sensors S1, S2, . . . . The correction unit 11 carries out unevenness correction processing on the basis of the initial brightness information at (T0) stored in the memory 16, the brightness information over time (T1) detected by the brightness detection sensors S1, S2, . . . , and the adjusted value of the light emission amount for each light source block from the light source drive conditions setting unit 19. This unevenness correction processing is carried out on the image signal input to the display unit 12, so as to approximate the initial brightness distribution at (T0).

Brightness unevenness in the display image can be suppressed by means of the light source drive circuit unit 14 driving the light source 13 according to the light source drive conditions determined in steps S209 to S211, and by means of the display unit 12 adjusting the transmission rate of the liquid crystals on the basis of the image signal that has been corrected for unevenness.

In other words, it is possible to suppress brightness unevenness in the display image, even if there are individual differences in the extent of deterioration over time of the LEDs which are connected to the same LED drive circuit.

In the present example, a case is described in which the light source blocks are constituted by two individual light sources, for the sake of simplicity, but the present example can also be applied to a case where light sources are arranged in a two-dimensional configuration. In one example, one light source block is constituted by four individual light sources, and FIG. 11 shows a case in which individual light sources are arranged two-dimensionally.

Figure 11:
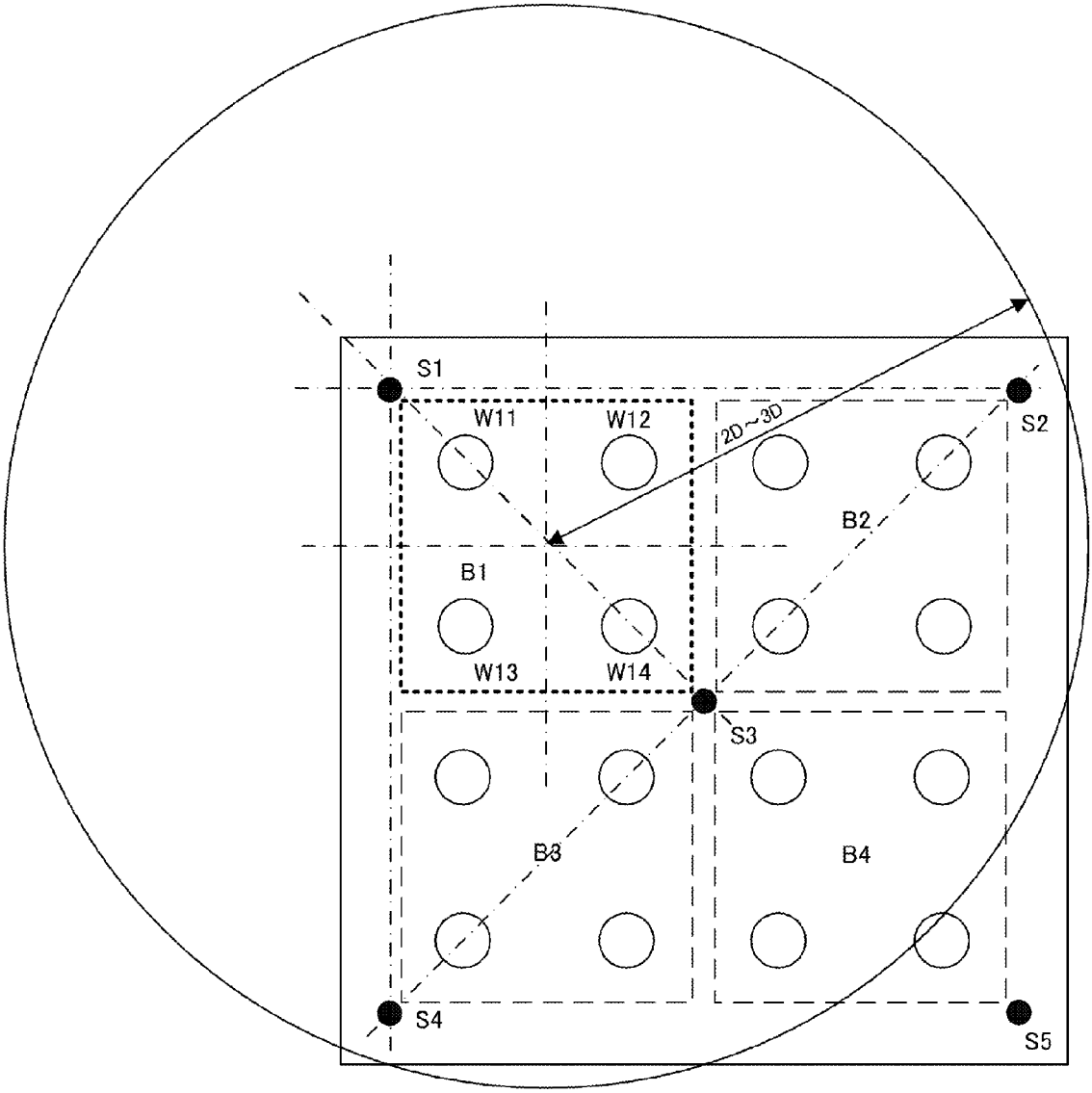
FIG. 11 is a diagram showing a case where a first example is applied to a light source having a two-dimensional configuration.

In the example shown in FIG. 11, there are brightness detection sensors S1, S2, S3 and S4 in a range of 2D to 3D from the center of the light source block B1. The relationship between the brightness detection values detected by the brightness detection sensors S1, S2, S3 and S4 and the brightness distribution of the respective individual light sources when each of the individual light source W11 to the individual light source W14 are each lit, one at a time, is measured, and coefficients $C_{W11S1}$ to $C_{W14S4}$ relating to the diffusion structure of the light source block are calculated. The brightness distribution of the light source block B1 is estimated on the basis of these coefficients and the brightness detection values from the brightness detection sensors when the light source block B1 is lit. In the case of FIG. 11, the brightness distribution is calculated in respect of the cross-section S1-S2, the cross-section S1-S3, the cross-section S1-S4 and the cross-section S2-S3-S4, and a two-dimensional brightness distribution shape is estimated by linking together the dots of equal brightness in the brightness distribution of each cross-section, by interpolative calculation, or the like. Non-uniformity correction is applied to the image signal input to the display unit 12, on the basis of the two-dimensional brightness distribution shape. Consequently, even in cases where there is unevenness in the extent of change in the brightness over time between the four individual light sources which constitute the light source block, unevenness in the display image can be suppressed.

Since the composition of the light source block such as that shown in FIG. 11 has a linearly symmetrical shape about the cross-section S2-S4, then the coefficients $C_{W11S1}$ to $C_{W14S4}$ relating to the diffusion structure determined in respect of the light source block B1 can be applied to the brightness detection sensors of the other light source block B4. As described above, if the relationship in the diffusion structure of the light source block and the arrangement of the brightness detection sensors is symmetrical or identical, then it is possible to simplify the calculation of coefficients relating to the diffusion structure.

There are no particular restrictions on the number of individual light sources which constitute the same light source block. From the viewpoint of estimating the brightness distribution of the light source blocks, it is desirable to arrange the brightness detection sensors at the corners of the light source block. The arrangement of the brightness detection sensors can be considered in identical fashion in the central portion and the edge portions of the light source 13.

Second Example

In the first example, the driving of the light source is corrected so as to raise the brightness of the light source W12 which shows the largest decline in brightness, among the extents of brightness change shown in FIG. 7, to the brightness value at the initial timing (T0). The region where the brightness is raised compared to the initial timing, by correction of the light source driving, is estimated, and brightness unevenness is suppressed by using image signal processing to reduce the brightness in this region.

In the second example, the brightness of the other light source is raised in such a manner that the brightness of the other light source matches the brightness of the light source showing the smallest decline in brightness. In the case of the example in FIG. 7, light source driving is corrected so as to raise the brightness of the light source block B1 by approximately 26%, in such a manner that the extent of the brightness change of the light source W12 having an extent of brightness change of 0.750 becomes equal to the extent of the brightness change of the light source W11 showing the smallest decline in brightness, which is 0.950. The region where the brightness is raised compared to the initial timing, by correction of the light source driving, is estimated, and signal processing for suppressing brightness unevenness is applied to the image signal in this region.

According to the present example, it is possible to suppress increase in power consumption by restricting the correction of brightness increase in the driving of the light source, to the difference between the light source showing the largest decline in brightness and light source showing the smallest decline in brightness.

Third Example

The third example is an example where only brightness unevenness correction by image signal processing is carried out on the basis of the brightness distribution shape estimated in step S206 in FIG. 6, and correction of the light source driving is not carried out.

Figure 12:
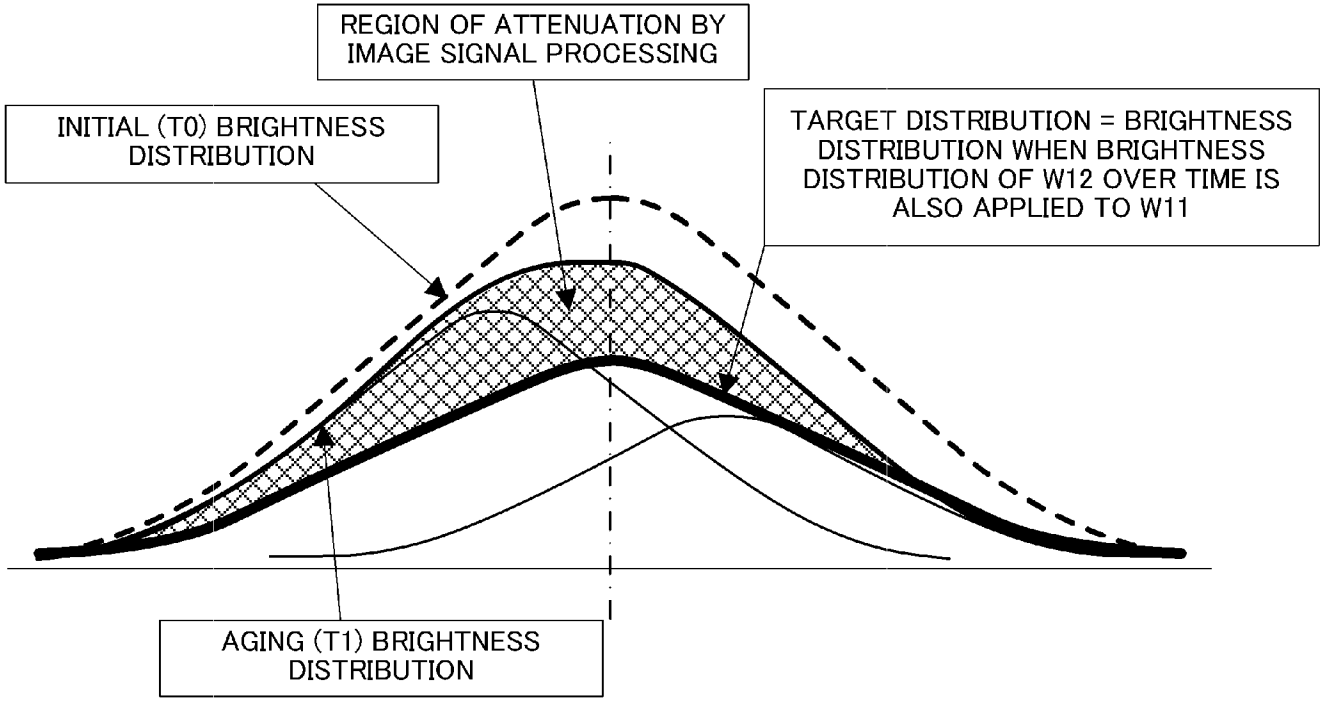
FIG. 12 is a diagram showing the results of unevenness correction according to a third example.

The third example is described here with reference to FIG. 8 to FIG. 12. FIG. 12 shows the results of unevenness correction according to the third example.

In the third example, firstly, the brightness distribution shape of the individual light source which shows the largest decline in brightness is estimated, and the brightness distribution of the light source block when the estimated brightness distribution is applied to all of the light sources in the same light source block is determined. The image signal processing is carried out on the basis of this brightness distribution (target distribution (target profile)).

To give a description using the example in FIG. 8, the decline in the brightness of the individual light source W12 (which is determined by Expression (9)) is largest. Therefore, it is supposed that the shape of the brightness distribution of the individual light source W11 after the passage of time is the same as the shape of the brightness distribution of the individual light source W12 after the passage of time. The brightness distribution shape of the light source block B1 obtained by adding together the brightness distributions of the individual light source W11 and the individual light source W12 is set as a target brightness distribution shape, and brightness unevenness correction by image signal processing is carried out on the basis of this target brightness distribution shape. In other words, image processing is carried out so as to cancel out the difference between the brightness distribution and the actual brightness distribution, when it is supposed that the brightness of the individual light sources other than the individual light source showing the largest decline in brightness has declined to a brightness equal to the brightness of the individual light source showing the largest decline in brightness. In a region near the individual light source which does not show a large decline in brightness, the transmissivity of the liquid crystals is made lower than in the region near to the individual light source showing a large decline in brightness, by implementing image processing so as to reduce the pixel values, whereby unevenness in the display brightness can be suppressed as a result.

According to the present example, brightness unevenness resulting from unevenness in the deterioration of the light source can be corrected accurately without giving rise to an increase in the brightness of the light source.

Examples 1 to 3 above are practical examples of the present invention, but the present invention is not limited to the embodiments given above and can be modified in various ways.

For example, the light source 13 may emit white light by lighting individual light sources of a plurality of colors, such as red, green, blue, etc., in a prescribed ratio.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-020511, filed on Feb. 5, 2013, and Japanese Patent Application No. 2013-262205, filed on Dec. 19, 2013, which are hereby incorporated by reference herein in their entirety.

What is claimed is:

1. An image display apparatus, comprising:

an illumination unit having a light source block including a plurality of light sources;

a display unit which displays an image on the basis of an image signal;

a plurality of measurement units which measure the brightness of light arriving from the light source block, at a plurality of measurement positions;

a storage unit which stores brightness information relating to an initial brightness of light arriving from the light source block at, at least, the plurality of measurement positions;

a setting unit which adjusts a light emission amount of the light source block on the basis of the brightness information stored in the storage unit, and measurement results from the plurality of measurement units when the light source block is lit; and a correction unit which corrects the image signal on the basis of the brightness information stored in the storage unit, the measurement results from the plurality of measurement units, and the adjusted light emission amount of the light source block.

2. The image display apparatus according to claim 1, wherein the brightness information stored in the storage unit is brightness distribution information relating to an initial brightness distribution of light arriving from the light source block, the image display apparatus further comprises an estimation unit which estimates a brightness distribution when the light source block is lit, on the basis of the brightness distribution information stored in the storage unit, and measurement results from the plurality of measurement units, and the correction unit calculates brightness distribution information for the light source block after adjustment, on the basis of the brightness distribution estimated by the estimation unit and the adjusted light emission amount of the light source block, and corrects the image signal on the basis of the difference between the calculated brightness distribution information and the brightness distribution information stored in the storage unit.

3. The image display apparatus according to claim 1, wherein the illumination unit has a plurality of light source blocks, the light source blocks each having a plurality of light sources, the storage unit stores, for each light source block, brightness information relating to an initial brightness of the light arriving from the light source block at, at least, the plurality of measurement positions, the setting unit adjusts, for each light source block, the light emission amount of the light sources of the light source block, on the basis of the brightness information for the light source block stored in the storage unit and the measurement results from the plurality of measurement units when the light source block is lit, and the correction unit corrects, for each light source block, an image signal of an image region corresponding to the light source block, on the basis of the brightness information for the light source block stored in the storage unit, the measurement results from the plurality of measurement units, and the adjusted light emission amount of the light source block.

4. The image display apparatus according to claim 3, wherein the brightness information for each light source block stored in the storage unit is brightness distribution information relating to an initial brightness distribution of light arriving from the light source block, the image display apparatus further comprises an estimation unit which estimates, for each light source block, the brightness distribution when the light source block is lit, on the basis of the brightness distribution information for the light source block stored in the storage unit, and the measurement results from the plurality of measurement units, and the correction unit calculates, for each light source block, the brightness distribution information of the light source block after adjustment, on the basis of the brightness distribution when the light source block is lit as estimated by the estimation unit, and the adjusted light emission amount of the light source block, and corrects the image signal of the image region corresponding to the light source block, on the basis of the difference between the calculated brightness distribution information and the brightness distribution information for the light source block stored in the storage unit.

5. The image display apparatus according to claim 1, wherein the setting unit adjusts the light emission amount in units of the light source block.

6. The image display apparatus according to claim 2, wherein the estimation unit estimates the brightness distribution of the light source block when the plurality of light sources of the light source block are lit, on the basis of measurement results from measurement units located in a predetermined range from the light source block.

7. The image display apparatus according to claim 2, wherein the estimation unit determines, for each light source block, that there is unevenness in the extent of deterioration of the plurality of light sources of the light source block, and estimates the brightness distribution of the light source block, if the ratio of the brightness when the light source block is lit as measured by the measurement unit at the measurement position, with respect to the initial brightness of the light arriving from the light source block at the measurement position of the measurement unit stored in the storage unit, is different among the measurement units.

8. The image display apparatus according to claim 7, wherein, if it is determined that there is unevenness in the extent of deterioration of the plurality of light sources of the light source block, the setting unit adjusts the light emission amount of the light source block in such a manner that the brightness of the light source which shows a largest decline in brightness becomes equal to an initial brightness of the light source, or in such a manner that the brightness of the light source which shows a largest decline in brightness becomes equal to the brightness of the light source which shows a smallest decline in brightness.

9. The image display apparatus according to claim 7, wherein, if it is determined that there is unevenness in the extent of deterioration of the plurality of light sources of the light source block, the setting unit does not adjust the light emission amount of the light source block, and the correction unit calculates brightness distribution information of the light source block assuming that the extent of decline in the brightness of all of the light sources of the light source block is equal to the extent of decline in the brightness of the light source which shows a largest decline in brightness, and corrects the image signal on the basis of the difference between the calculated brightness distribution information and the brightness distribution estimated by the estimation unit.

10. The image display apparatus according to claim 2, wherein the estimation unit determines, for each light source block, that there is no unevenness in the extent of deterioration of the plurality of light sources of the light source block, and estimates the brightness distribution of the light source block on the basis of initial brightness distribution information for the light source block stored in the storage unit, if the ratio of the brightness when the light source block is lit as measured by the measurement unit at the measurement position, with respect to the initial brightness of the light arriving from the light source block at the measurement position of the measurement unit stored in the storage unit, is the same among the measurement units.

11. A method for controlling an image display apparatus that includes:

an illumination unit having a light source block including a plurality of light sources;

a display unit which displays an image on the basis of an image signal; and a plurality of measurement units which measure the brightness of light arriving from the light source block, at a plurality of measurement positions, the method comprising:

reading, from a storage unit, brightness information relating to an initial brightness of light arriving from the light source block at, at least, the plurality of measurement positions;

adjusting a light emission amount of the light source block on the basis of the brightness information stored in the storage unit, and measurement results from the plurality of measurement units when the light source block is lit; and correcting the image signal on the basis of the brightness information stored in the storage unit, the measurement results from the plurality of measurement units, and the adjusted light emission amount of the light source block.

12. The method for controlling an image display apparatus according to claim 11, wherein the brightness information stored in the storage unit is brightness distribution information relating to an initial brightness distribution of light arriving from the light source block, the method further comprises estimating a brightness distribution when the light source block is lit, on the basis of the brightness distribution information stored in the storage unit and measurement results from the plurality of measurement units, and in the correcting, brightness distribution information for the light source block after adjustment is calculated on the basis of the brightness distribution estimated in the estimating and the adjusted light emission amount of the light source block, and the image signal is corrected on the basis of the difference between the calculated brightness distribution information and the brightness distribution information stored in the storage unit.

13. The method for controlling an image display apparatus according to claim 11, wherein the illumination unit has a plurality of light source blocks, the light source blocks each having a plurality of light sources, the storage unit stores, for each light source block, brightness information relating to an initial brightness of the light arriving from the light source block at, at least, the plurality of measurement positions, in the adjusting, the light emission amount of the light sources of the light source block is adjusted for each light source block on the basis of the brightness information for the light source block stored in the storage unit and the measurement results from the plurality of measurement units when the light source block is lit, and in the correcting, an image signal of an image region corresponding to the light source block is corrected for each light source block on the basis of the brightness information for the light source block stored in the storage unit, the measurement results from the plurality of measurement units, and the adjusted light emission amount of the light source block.

14. The method for controlling an image display apparatus according to claim 13, wherein the brightness information for each light source block stored in the storage unit is brightness distribution information relating to an initial brightness distribution of light arriving from the light source block, the method further comprises estimating, for each light source block, the brightness distribution when the light source block is lit, on the basis of the brightness distribution information for the light source block stored in the storage unit, and the measurement results from the plurality of measurement units, and in the correcting, for each light source block, the brightness distribution information of the light source block after adjustment is calculated on the basis of the brightness distribution when the light source block is lit as estimated in the estimating, and the adjusted light emission amount of the light source block, and the image signal of the image region corresponding to the light source block is corrected on the basis of the difference between the calculated brightness distribution information and the brightness distribution information for the light source block stored in the storage unit.

15. The method for controlling an image display apparatus according to claim 11, wherein, in the adjusting, the light emission amount can be adjusted in units of the light source block.

16. The method for controlling an image display apparatus according to claim 12, wherein, in the estimating, the brightness distribution of the light source block when the plurality of light sources of the light source block are lit is estimated, on the basis of measurement results from measurement units located in a predetermined range from the light source block.

17. The method for controlling an image display apparatus according to claim 12, wherein, in the estimating, for each light source block, it is determined that there is unevenness in the extent of deterioration of the plurality of light sources of the light source block, and the brightness distribution of the light source block is estimated, if the ratio of the brightness when the light source block is lit as measured by the measurement unit at the measurement position, with respect to the initial brightness of the light arriving from the light source block at the measurement position of the measurement unit stored in the storage unit, is different among the measurement units.

18. The method for controlling an image display apparatus according to claim 17, wherein, if it is determined that there is unevenness in the extent of deterioration of the plurality of light sources of the light source block, the light emission amount of the light source block is adjusted in the adjusting in such a manner that the brightness of the light source which shows a largest decline in brightness becomes equal to an initial brightness of the light source, or in such a manner that the brightness of the light source which shows a largest decline in brightness becomes equal to the brightness of the light source which shows a smallest decline in brightness.

19. The method for controlling an image display apparatus according to claim 17, wherein, if it is determined that there is unevenness in the extent of deterioration of the plurality of light sources of the light source block, then the light emission amount of the light source block is not adjusted in the adjusting, and brightness distribution information of the light source block is calculated in the correcting assuming that the extent of decline in the brightness of all of the light sources of the light source block is equal to the extent of decline in the brightness of the light source which shows a largest decline in brightness, and the image signal is corrected in the correcting on the basis of the difference between the calculated brightness distribution information and the brightness distribution estimated in the estimating.

20. The method for controlling an image display apparatus according to claim 12, wherein, in the estimating, for each light source block, it is determined that there is no unevenness in the extent of deterioration of the plurality light sources of the light source block, and the brightness distribution of the light source block is estimated on the basis of initial brightness distribution information for the light source block stored in the storage unit, if the ratio of the brightness when the light source block is lit as measured by the measurement unit at the measurement position, with respect to the initial brightness of the light arriving from the light source block at the measurement position of the measurement unit stored in the storage unit, is the same among the measurement units.

* * * * *